US006513360B1

(12) United States Patent
Ito et al.

(10) Patent No.: US 6,513,360 B1
(45) Date of Patent: Feb. 4, 2003

(54) RESINOUS DIE

(75) Inventors: Yasushi Ito, Sayama (JP); Toshiyuki Usui, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/631,533

(22) Filed: Aug. 3, 2000

(30) Foreign Application Priority Data

Aug. 4, 1999 (JP) ..... 11-221769

(51) Int. Cl.[7] ..... B29C 35/00; B21J 13/02

(52) U.S. Cl. ..... 72/462; 425/398; 425/412; 425/469; 425/470; 425/400; 249/80; 249/134; 72/476; 76/107.1

(58) Field of Search ..... 425/400, 412, 425/398, 470, 469, 384; 249/114.1, 134, 112, 80; 72/462, 476; 76/107.1

(56) References Cited

U.S. PATENT DOCUMENTS 2,708,288 A * 5/1955 Fuller et al. ..... 264/122
3,520,750 A * 7/1970 Li et al. ..... 156/199
3,548,050 A * 12/1970 Mozer ..... 264/227
4,563,325 A * 1/1986 Coffman ..... 264/550
4,702,304 A * 10/1987 Rice ..... 164/529
5,040,962 A * 8/1991 Waszeciak et al. ..... 425/112
5,057,256 A 10/1991 Gorin ..... 264/113
5,156,754 A * 10/1992 Nomura et al. ..... 249/134
5,348,798 A * 9/1994 Berghuis et al. ..... 428/285

FOREIGN PATENT DOCUMENTS

GB 1189916 4/1970
GB 1287600 8/1972
GB 2254819 10/1992

OTHER PUBLICATIONS

United Kingdom Search Report

* cited by examiner

*Primary Examiner*—Jan H. Silbaugh
*Assistant Examiner*—Joseph S Del Sole
(74) *Attorney, Agent, or Firm*—Merchant & Gould, P.C.

(57) ABSTRACT

A resinous die for press-shaping a blank material into a desired configuration, which comprises a die member and a mating punch, both having respective shaping portions. Each shaping portion is formed of an epoxy resin layer provided at portions thereof where a relatively low surface pressure is applied, and a plurality of reinforcing pieces provided in an embedded fashion at portions thereof where a relatively high surface pressure is applied, for reinforcing the shaping portion. This arrangement imparts increased durability to the shaping portion and hence the die while keeping the cost of manufacture of the die to a minimum.

10 Claims, 7 Drawing Sheets

RESINOUS DIE

BACKGROUND OF THE INVENTION

1. Field of the Invention

This invention relates to an improvement in a resinous die for pressing a blank material into a desired shape.

2. Description of the Prior Art

A vehicle body panel for forming a vehicle body is provided by pressing a blank material in a pressing die into a desired shape. Known pressing dies are made from cast iron or steel. Pressing dies made from cast iron or steel have excellent durability. Thus, the relatively high costs of such pressing dies can be recovered by mass producing intended products.

In recent years, however, automobiles are subjected to frequent model changes to meet a diversity of demands and are now becoming the targets of diversified-model little production. When pressing dies made of cast iron or steel are used in the diversified-model little production, failure may be experienced in recovering the whole costs of those dies, thus making it difficult to keep the costs of production of intended automobiles to a minimum.

Thus, pressing dies for use in the diversified-model little production are usually made of thermoplastic resins. Such resinous dies greatly contribute to the reduction of die costs compared to the cast iron or steel dies. Thus, use of such resinous dies enables automobile model changes in relatively short cycles without increasing the costs of production of automobiles.

However, such resinous dies can more easily wear out than the cast iron or steel dies because they are less rigid than the latter dies. With forming or shaping portions of the resinous dies worn out, it is quite difficult to ensure precision in the resulting press-shaped articles. To ensure precision in the shaped articles, it is necessary for the dies to be changed before the shaping portions of the dies wear out.

Since the resinous dies need to be changed relatively frequently in order to ensure precision in the shaped article, it is often difficult to fully recover the costs of the dies. Accordingly, there is a demand for a resinous die with increased durability.

SUMMARY OF THE INVENTION

It is therefore an object of the present invention to provide a resinous die which has increased durability and hence can keep the die costs to a minimum.

According to an aspect of the present invention, there is provided a resinous die for press-shaping a blank material into a desired configuration, which comprises: a die member including a shaping portion, the shaping portion being formed of an epoxy resin layer provided at portions thereof where a relatively low surface pressure is applied, and a plurality of reinforcing pieces provided at portions thereof where a relatively high surface pressure is applied, for reinforcing the shaping portion; and a punch including a shaping portion, the shaping portion being formed of an epoxy resin layer provided at portions thereof where a relatively low surface pressure is applied, and a plurality of reinforcing pieces provided at portions thereof where a relatively high surface pressure is applied, for reinforcing the shaping portion of the punch.

Those portions of each shaping portion which are applied with a relatively low surface pressure are thus formed of an epoxy resin which is inexpensive compared to cast iron. As a result, the cost of manufacture of the shaping portions and hence the die can be reduced. Further, by virtue of the reinforcing pieces of aluminum-copper-based zinc alloy which have a hardness far greater than that of an epoxy resin and are provided at those portions of the shaping portions where a relatively high surface pressure is applied, the shaping portions and hence the die are imparted with increased wear resistivity, thereby prolonging the life of the die.

It is desired that the reinforcing pieces of the die member and punch have a hardness of about HV 96 kgf/mm$^2$.

Preferably, the reinforcing members of the die member and punch are made of an aluminum-copper-based zinc alloy.

Desirably, the epoxy resin layers of the shaping portions of the die member and punch have a thickness falling in a range of 20–30 mm. The reinforcing pieces of the shaping portions of the die member and punch may be partly embedded in the epoxy resin layers.

Preferably, the die member has a backup portion provided on a reverse side of the shaping portion of the die member for backing up the die member shaping portion. Preferably, the punch has a backup portion provided on a reverse side of the shaping portion of the punch for backing up the punch shaping portion.

In a preferred form, the backup portion of the die member comprises a filler layer provided by hardening a filler formed of an adhesive containing sand. The filler layer preferably has embedded therein frameworks for reinforcing the filler layer, and cooling pipes for passing cooling water therethrough to cool the die member.

In a preferred form, the backup portion of the punch comprises a filler layer provided by hardening a filler formed of an adhesive containing sand. Preferably, the filler layer has embedded therein a framework for reinforcing said filler layer, and cooling pipes for passing cooling water therethrough to cool the punch.

Desirably, the die further comprises a blank holder disposed vertically movably around the punch for holding a flange of the blank material in cooperation with a mating portion of the shaping portion of the die member upon press-shaping of the blank material to thereby prevent wrinkling of the flange of the blank material. The blank holder may comprise an epoxy resin layer provided on a side thereof opposed to the mating portion of the shaping portion of the die member.

In a preferred form, the blank holder comprises a backup portion provided on a reverse side of the epoxy resin layer for backing up the epoxy resin layer. The backup portion desirably comprises a filler layer provided by hardening a filler formed of an adhesive containing sand and having embedded therein cooling pipes for passing cooling water therethrough to cool the blank holder.

BRIEF DESCRIPTION OF THE DRAWINGS

A certain preferred embodiment of the present invention will now be described in detail, by way of example only, with reference to the accompanying drawings, in which.

DETAILED DESCRIPTION OF THE PREFERRED EMBODIMENT

The following description is merely exemplary in nature and is in no way intended to limit the invention, its application or uses.

Figure 1:
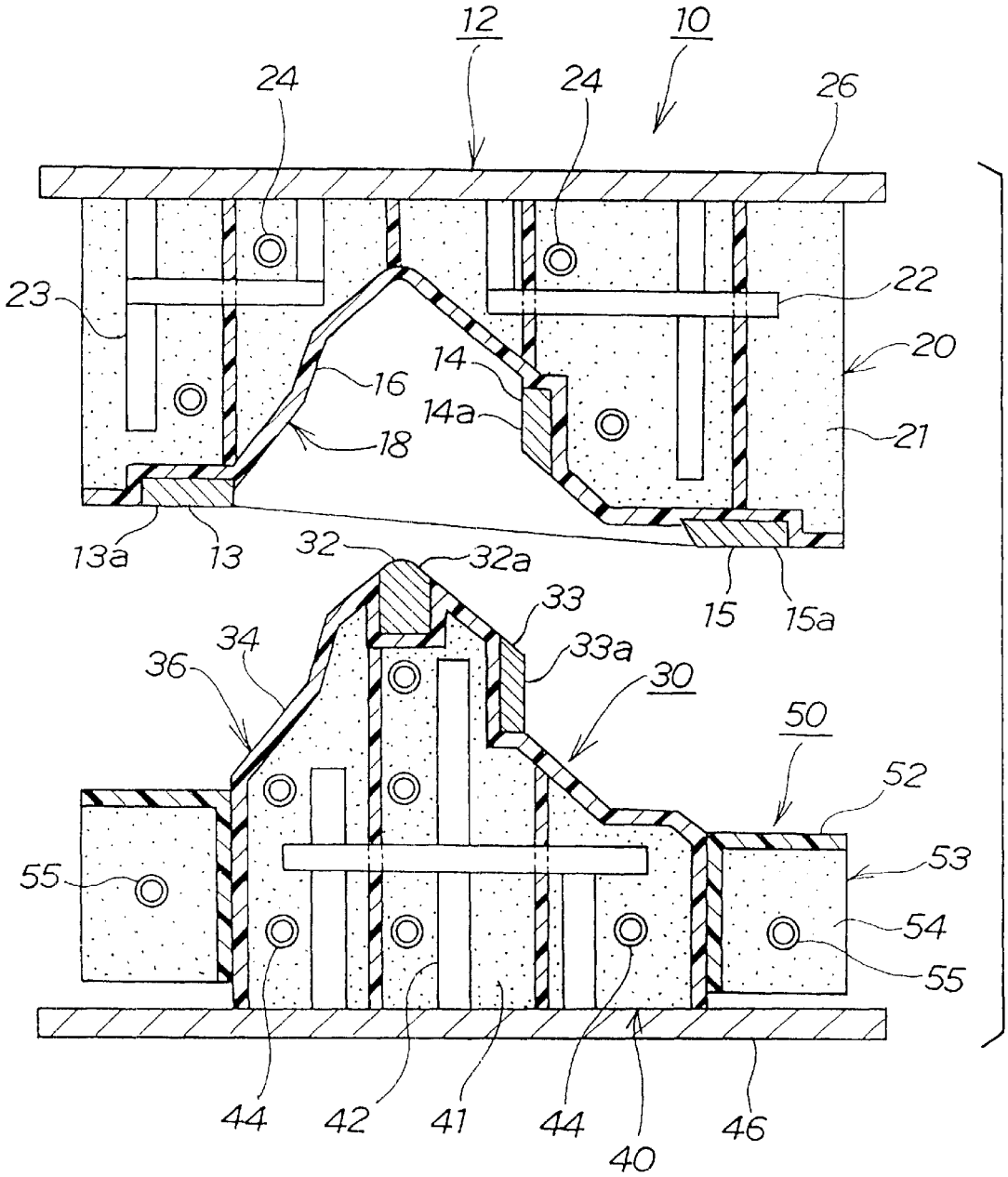
FIG. 1 is a cross-sectional view illustrating a resinous die according to the present invention.

Referring initially to FIG. 1, a resinous die 10, designed for pressing-shaping a blank material into a desired configuration to thereby provide a panel for forming a vehicle body, comprises a die member 12 positioned at an upper level thereof, a punch member 30 provided vertically movably and positioned downwardly of the die member 12, and a blank holder 50 vertically movably disposed around the punch member 30.

Die member 12 comprises a forming or shaping portion 18 provided in opposed relation to the punch 30. The shaping portion 18 includes a plurality of reinforcing pieces 13, 14, 15 of aluminum-copper-based zinc alloy provided at portions thereof where a relatively high surface pressure is applied, and an epoxy resin layer 16 provided at portions thereof where a relatively low surf ace pressure is applied. On a reverse side of the shaping portion 18. a backup portion 20 is provided for backing up the shaping portion 18. Attached to a reverse or upper side of the backup portion 20 is an upper plate 26.

Reinforcing pieces 13, 14, 15, made from; aluminum-copper-based zinc alloy, have a Vickers hardness (hereinafter "HV") of 96 kgf/mm$^2$ and hence are relatively hard. The aluminum-copper-based zinc alloy used herein is composed of 4.1% by weight of aluminum (Al), 3.0% by weight of copper (Cu), 0.04% by weight of magnesium (Mg), and the balance of zinc (Zn).

Reinforcing pieces 13, 14, 15 are embedded in the epoxy resin layer 16 with their respective surfaces 13*a*, 14*a*, 15*a* exposed to air. The reinforcing pieces 13, 14, 15 impart increased wear resistivity to the high-surface-pressure-applied portions of the die member 12, thereby prolonging the life of the die member 12.

Generally, cast iron (FC300) for manufacturing the press-shaping die is as hard as HV 247 kgf/mm$^2$ and has a melting temperature as high as 1300° C. In contrast, the aluminum-copper-based zinc alloy used herein has a melting temperature as low as 380° C., thereby rendering the manufacture of the reinforcing pieces 13, 14, 15 easy. Consequently, it is possible to provide the reinforcing pieces at a relatively low cost.

Resin layer 16 is composed of an epoxy resin of HV 43 kgf/mm$^2$ hardness and has a thickness designed to fall in a range of 20–30 mm. with the thickness set to be 20 mm or larger, the epoxy resin layer 16 allows firm embedding of the reinforcing pieces 13–15 therein. On the other hand, by setting the thickness of the epoxy resin layer 16 to be 30 mm or smaller, the quantity or a molten epoxy resin for forming the layer 16 can be limited. As a result, times required for pouring and hardening of the molten resin can be shortened, thereby increasing the productivity.

Backup portion 20 comprises a filler layer 21 in which frameworks 22, 23 and cooling pipes 24 are embedded. The filler layer 21 is provided by hardening a filler formed of an adhesive containing sand. The frameworks 22, 23 are provided for reinforcing the filler layer 21. Cooling water flows through the cooling pipes 24 for cooling the die member 12.

Punch 30 comprises a forming or shaping portion 36 for shaping, in cooperation with the shaping portion 18 of the die member 12, the press-shaped article into a desire configuration. The shaping portion 36 comprises a plurality of reinforcing pieces 32, 33 of aluminum-copper-based zinc alloy provided at portions thereof where a relatively high surface pressure is applied, and an epoxy resin layer 34 provided at portions thereof where a relatively low surface pressure is applied. On a reverse side of the shaping portion 36, a backup portion 40 is provided for backing up the shaping portion 36. Attached to a reverse or lower side of the backup portion 40 is a lower plate 46.

Similarly to the reinforcing pieces 13–15, the reinforcing pieces 32, 33, made from aluminum-copper-based zinc alloy, have a hardness of 96 kgf /mm$^2$ and hence are relatively hard. The aluminum-copper-based zinc alloy is composed of 4.1% by weight of aluminum (Al), 3.0% by weight of copper (Cu), 0.04% by weight of magnesium (Mg), and the balance of zinc (Zn).

Reinforcing pieces 32, 33 are embedded in the epoxy resin layer 34 with their respective surfaces 32*a*, 33*a* exposed to air. The reinforcing pieces 32, 33 impart increased wear resistivity to the high-surface-pressure-applied portions of the punch 30, thereby prolonging the life of the punch 30.

As already mentioned in relation to the die member 12, cast iron (FC300) for manufacturing the press-shaping die is as hard as Hv 247 kgf/mm$^2$ and has a melting temperature as high as 1300° C. In contrast, the aluminum-copper-based zinc alloy has a melting temperature as low as 380° C., thereby rendering the manufacture of the reinforcing pieces 32, 33 easy. Consequently, it is possible to provide the reinforcing pieces 32, 33 at a relatively low cost.

Similarly to the resin layer 16, the resin layer 34 is composed of a thermal setting resin of HV 43 kgf/mm$^2$ hardness and has a thickness designed to fall in a range of 20–30 mm. With the thickness set to be 20 mm or larger, the resin layer 34 allows firm embedding of the reinforcing pieces 32, 33 therein. On the other hand, by setting the thickness of the resin layer 34 to be 30 mm or smaller, the quantity of a molten epoxy resin for forming the layer 34 can be limited. As a result, times required for pouring and hardening of the molten resin can be shortened, thereby increasing the productivity.

Backup portion 40, similarly to the backup portion 20, comprises a filler layer 41 in which a framework 42 and cooling pipes 44 are embedded. The filler layer 41 is provided by hardening a filler formed of an adhesive containing sand. The framework 42 is provided for reinforcing the filler layer 41. Cooling pipes 44 allow passage of cooling water therethrough for cooling the punch 30.

Blank holder 50 is disposed vertically movably around the punch 30 for preventing wrinkling of the press-formed article by holding a flange of the article together with a mating portion of the shaping portion 18 of the die member 12 upon press-shaping of the article, and comprises an epoxy resin layer 52. On a reverse side of the epoxy resin layer 52, a backup portion 53 is provided for backing up the epoxy resin layer 52. Similarly to the resin layer 16, the resin layer 52 is formed of an epoxy resin of Hv 43 kgf/mm$^2$ hardness and has a thickness set to be in a range of 20–30 mm.

Similarly to the backup portion 20, the backup portion 53 comprises a filler layer 54 in which cooling pipes 55, 55 are embedded. The filler layer 54 is provided by hardening a filler formed of an adhesive containing sand. The cooling pipes 55, 55 allow passage of cooling water therethrough for cooling the blank holder 50.

Discussion will be made next as to the manufacture of the resinous die with reference to FIG. 2A to FIG. 6B. Since the die member 12, punch 30 and blank holder 50 are all manufactured in the same manner, the discussion will be made in relation to only the punch 30 as an example.

Figure 2A:
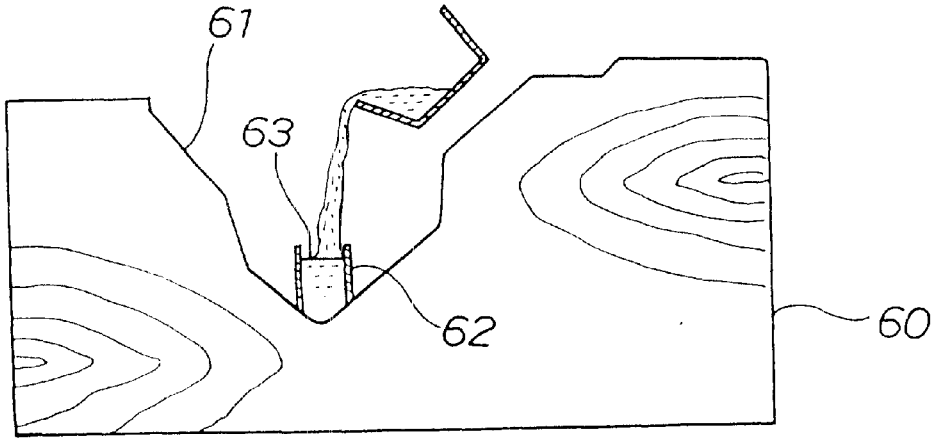
FIGS. 2A to 2C are schematic views illustrating a first stage of the process of manufacture of the resinous die.

As shown in FIG. 2A, a master model (wooden pattern) 60 for the die member 12 (FIG. 1) is positioned in an upward orientation. Then, a plaster molding box or flask 62 for receiving plaster is disposed at a predetermined portion of a shaping portion 61 of the master model 60. Thereafter, plaster 63 is poured into the molding box 62 and allowed to become hardened.

Figure 2B:
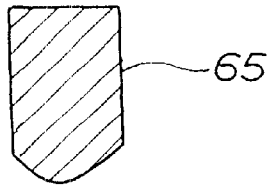

Hardened plaster (hereinafter "reference model") 65 is then released from the molding box 62 as shown in FIG. 2B.

Figure 2C:
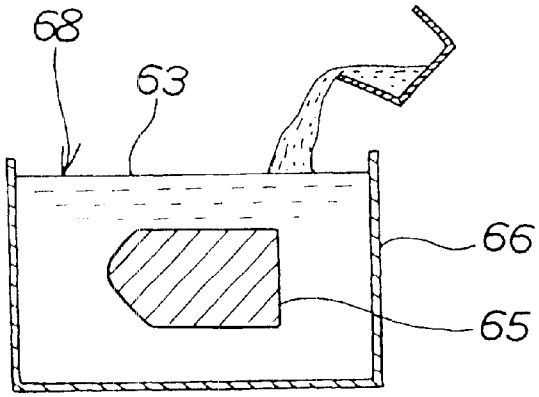

After the reference model 65 is coated all around with a die lubricant, the reference model 65 is placed in a plaster molding box 66 as shown in FIG. 2C. In this state, plaster 63 is poured into the molding box 66 such that the reference model 65 is embedded in the plaster 63. Upon hardening of the plaster 63, a plaster mold 68 is provided.

Figure 3A:
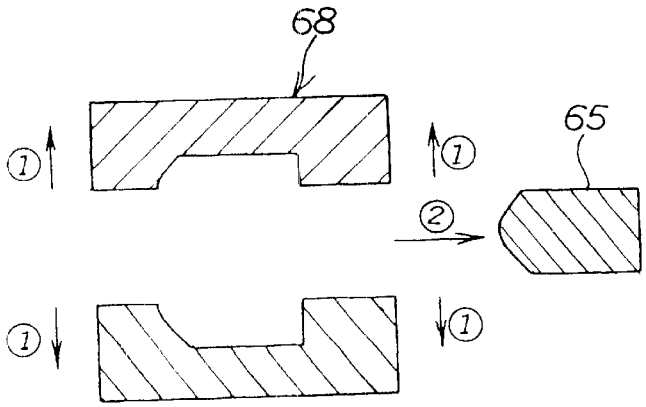
FIGS. 3A to 3C are schematic views illustrating a second stage of the process of manufacture of the die.

Turning to FIG. 3A, the hardened plaster mold 68 is released from the plaster molding box 66 shown in FIG. 2C. Then, the plaster mold 68 is divided into two halves as shown by arrows ①, whereupon the reference model 65 is taken out from the plaster mold 68.

Figure 3B:
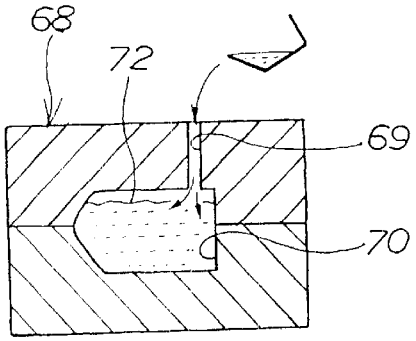

As shown in FIG. 3B, a runner 69 is formed in the upper half of the plaster mold 68, followed by clamping the plaster mold. Thereafter, a molten aluminum-copper-based zinc alloy 72 is poured through the runner 69 into a cavity 70. Upon solidification of the aluminum-copper-based zinc alloy 72 poured into the cavity 70, the reinforcing piece 32 as shown in FIG. 1 is provided.

Figure 3C:
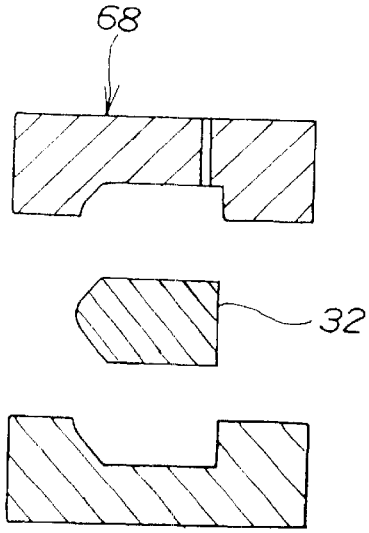

The plaster mold 68 is then unclamped so that the reinforcing piece 32 can be taken out as shown in FIG. 3C.

Figure 4A:
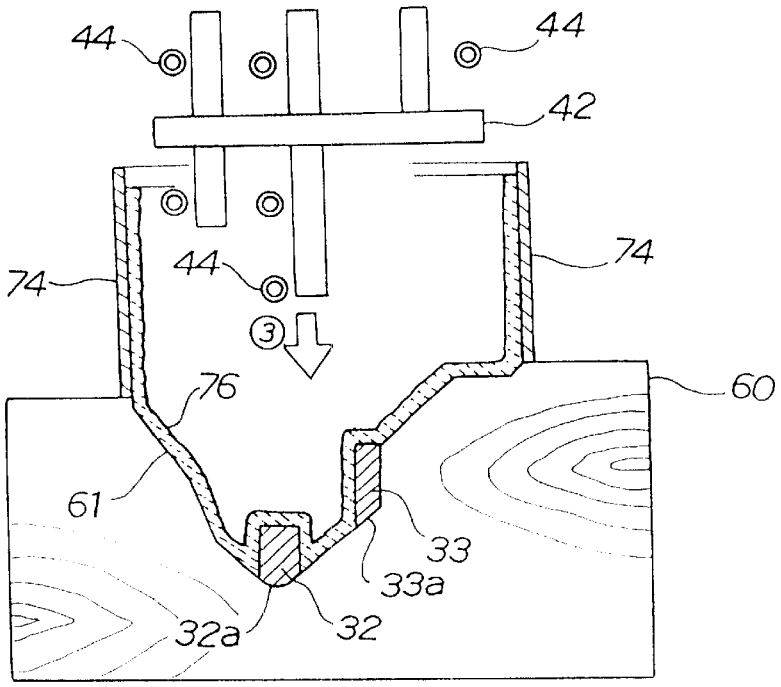
FIGS. 4A and 4B are schematic views illustrating a third stage of the process of manufacture of the die.

Turning now to FIG. 4A, the master model 60 for the die member 12 is readied. Then, two reinforcing pieces 32, 33 are adhered to the shaping portion 61 of the master model 60. It should be noted that the reinforcing piece 33 has been produced in the same manner as the reinforcing piece 32.

Next, a molding box 74 is positioned on an upper surface of the master model 60. A die lubricant is then applied to an internal surface of the molding box 74, the shaping portion 61 of the master model 60 and the surfaces 32*a*, 33*a* of the reinforcing pieces 32, 33, following which a urethane resin 76 is applied to lie on or line along the molding box internal surface, the shaping portion 61 and the surfaces 32*a*, 33*a* until it comes to have a thickness equal to the thickness (20–30 mm) of the epoxy resin layer 34 shown in FIG, 1.

Thereafter, the framework 42 and the cooling pipes 44 are positioned within a space defined inwardly of the urethane resin 76, as shown by arrow ③.

Figure 4B:
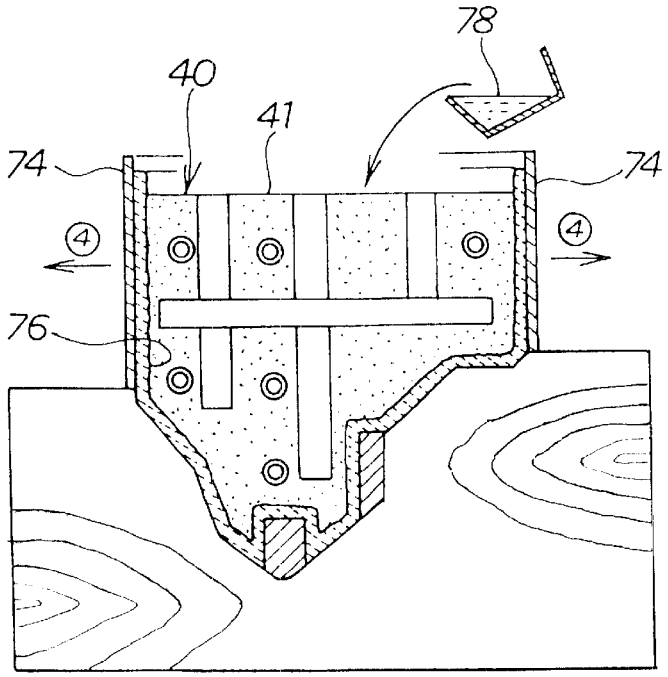

In FIG. 4B, after a die lubricant is applied to a surface of the urethane resin 76, the space defined inside the urethane resin 76 is filled with a liquid filler 78 formed of an adhesive containing sand, as shown by an arrow. The liquid filler 78 becomes hardened to thereby provide the filler layer 41 for serving as the backup portion 40. This is followed by removal of the molding box 74 from a peripheral wall of the urethane resin 76, as shown by arrows ④, ④.

As shown in FIG. A, the backup portion 40 is lifted apart from urethane resin 76 as shown by arrow⑤. With the die lubricant applied to the surface of the urethane resin 76, the backup portion 40 can be pulled apart from the urethane resin 76 easily.

Then, the urethane resin 76 is removed from the master model 60 as shown by arrows ⑥, ⑥. With the die lubricant also applied to a back surface of the urethane resin 76, the urethane resin 76 can be removed from the master model 60 easily.

Figure 5A:
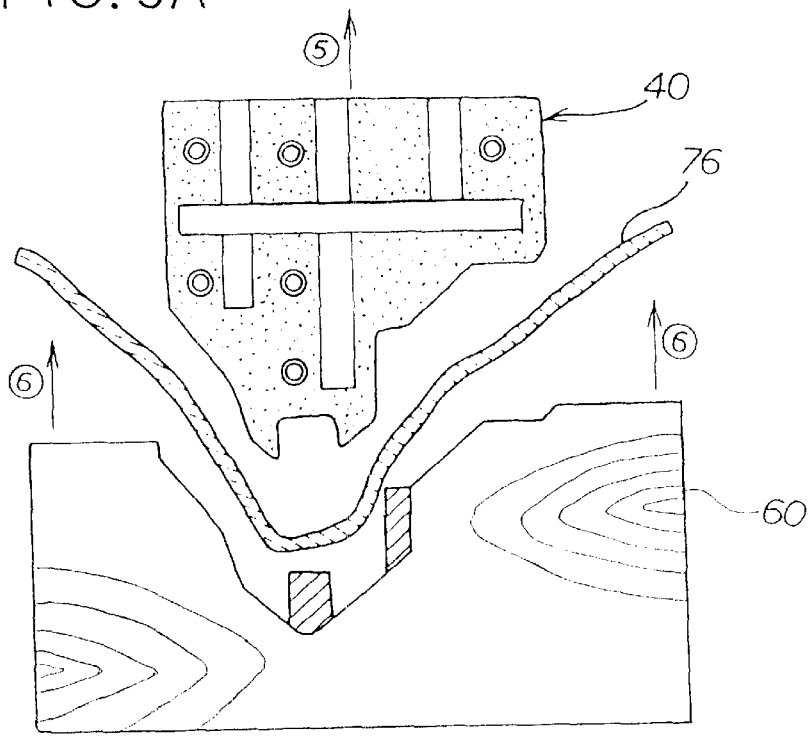
FIGS. 5A and 5B are schematic views illustrating a fourth stage of the process of manufacture of the die.
Figure 5B:
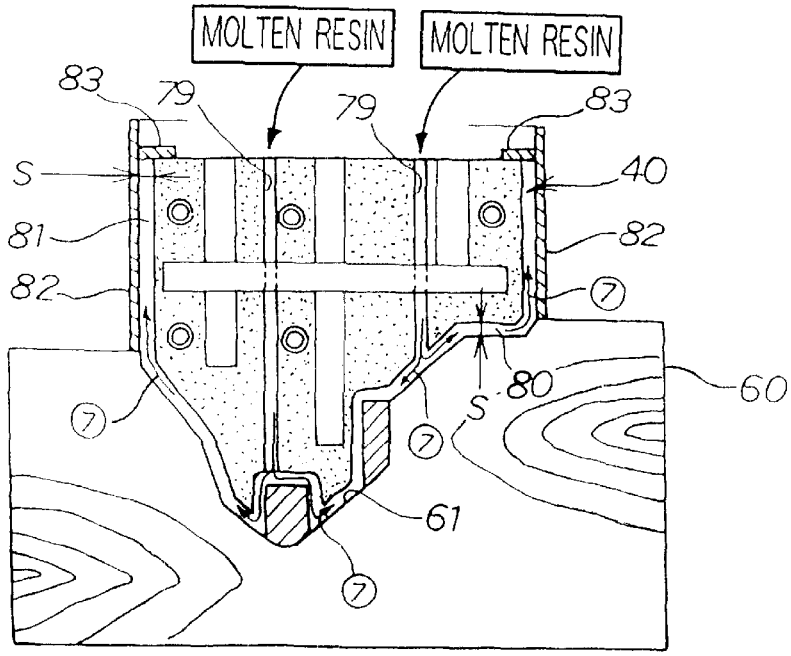

As shown in FIG. 5B, after runners or passages 79, 79 are formed in the backup portion 40, the backup portion 40 is placed on the master model 60. At this time, a gap 80 is formed between the backup portion 40 and the shaping portion 61 of the master model 60. A gap 81 is then formed in a side wall of the backup portion 40. Thereafter, molding boxes 82, 83 are disposed to surround the gaps 80, 81. Each of the gaps 80, 81 has a width S which is equal to the thickness of the urethane resin 76.

Molten epoxy resin is then poured into the resin passages 79, 79 of the backup portion 40, as shown by arrows. The molten resin fed into the passages 79, 79 flows into the gap 80 between the backup portion 40 and the master model 60 and into the gap 81 between the backup portion 40 and the molding box 82, as shown by arrows ⑦. This supplies molten resin to all over the surface area of the backup portion 40.

Figure 6A:
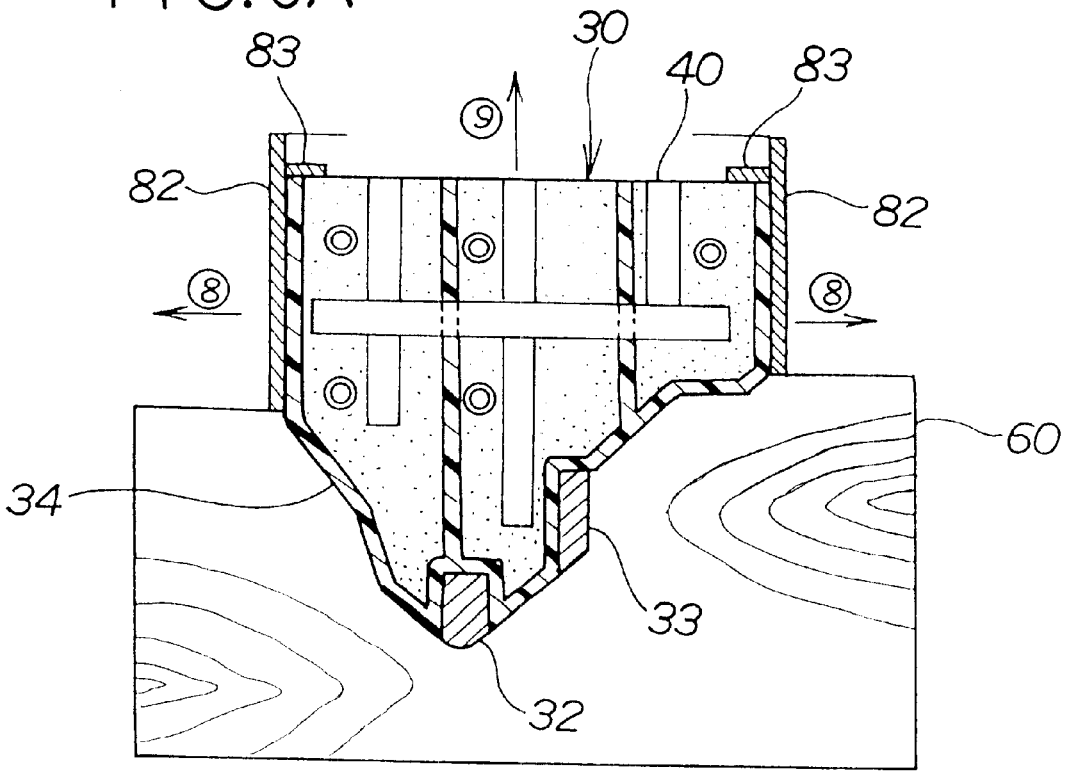
FIGS. 6A and 6B are schematic views illustrating a fifth stage of the process of manufacture of the die.

Turning now to FIG. 6A, the molten resin fed all over the surface area of the backup portion 40 solidifies to become the epoxy resin layer 34 of FIG. 1. This provides the punch 30 with the reinforcing pieces 32, 33 embedded in the epoxy resin layer 34. The molding boxes 82, 83 are then removed from the peripheral wall of the backup portion 40 as shown by arrows ⑧,⑧, following which the punch 30 is lifted as shown by arrow ⑨.

Figure 6B:
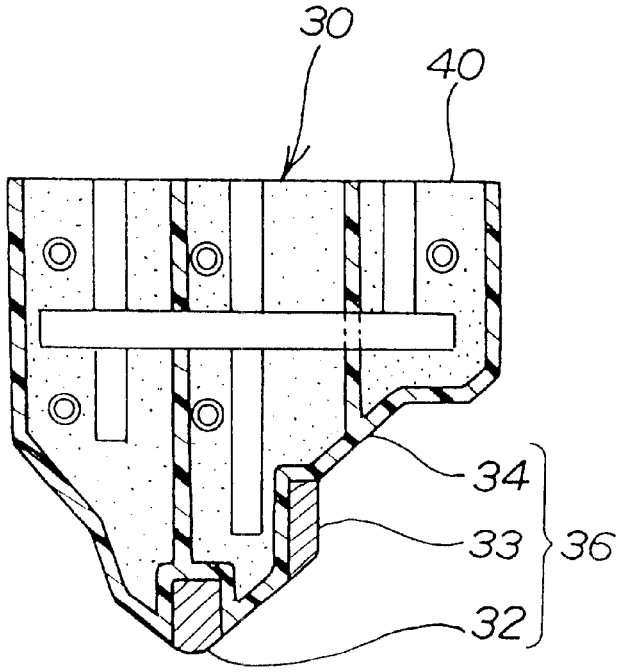

As shown in FIG. 6B, the punch 30 is then taken out from the master model 60, thereby completing the process of manufacture. As explained in relation to FIG. 1, the punch 30 comprises the shaping portion 36 formed of the epoxy resin layer 34 and the reinforcing pieces 32, 33 of aluminum-copper-based zinc alloy, and the backup portion 40 provided on the reverse side of the shaping portion 36.

Figure 7A:
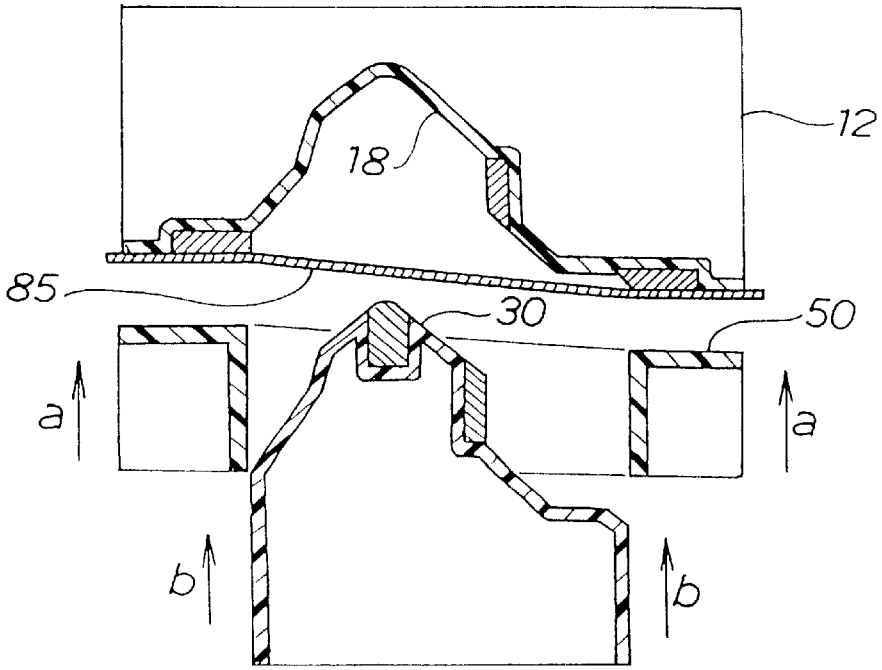
FIGS. 7A and 7B are partial cross-sectional views illustrating an operation of the die.
Figure 7B:
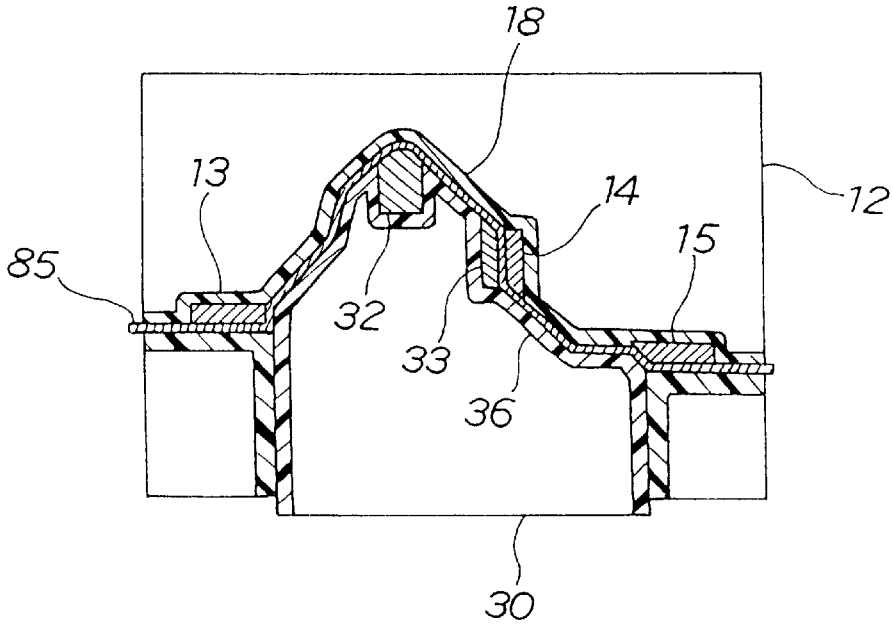

Reference is made next as to FIGS. 7A and 7B which exemplifies press-shaping of a blank material by using the resinous die produced in the manner as explained above.

As shown in FIG. 7*a*, a blank material 85 is placed on the shaping portion 18 of the die member 12. The flange holder 50 is actuated to move upwardly, as shown by arrows a, a, until a flange of the blank material 85 is held between the flange holder 50 and the die member 12. Then, the punch 30 is moved upwardly as shown by arrows b, b.

Thereafter, the punch 30 is pressed hard against the die member 12 to press-shape the blank material 85. At this time, the reinforcing pieces 13, 14, 15 of the die member 12 and the reinforcing pieces 32, 33 of the punch 30 are subjected to a high surface pressure. However, these reinforcing pieces 13–15 and 32, 33 have high wear resistivity, thereby increasing the durability of the die 10.

Performance test has been conducted as to the resinous die according to the present invention. The test results are as given in Table 1 below.

TABLE 1

| | | Comparative Example | Preferred Embodiment |
|---|---|---|---|
| Shaping Portion | | Epoxy Resin | Epoxy Resin with Reinforcing Pieces |
| Hardness of Epoxy Resin | | HV 43 kgf/mm$^2$ | HV 43 kgf/mm$^2$ |
| Hardness of Reinforcing Piece | | — | HV 96 kgf/mm$^2$ |
| Thickness of Epoxy Resin | | 20 mm | 20 mm |
| Press-Shaping Pressure | | 5 kgf/mm$^2$ | 5 kgf/mm$^2$ |
| Thickness of Blank Material | | 0.75 mm | 0.75 mm |
| Results | Wear of shaping Portion after 3000 Shots | Observed | Not Observed |
| | Evaluation | NG | G |

A resinous die as a comparative example and a resinous die according to the preferred embodiment as shown in Table 1 were readied. In each resinous die, blank material press-shaping has been carried out 3000 times to find out if the dies exhibit any wear at shaping portions thereof. When certain wear is observed, this is evaluated to be NG (No Good). When substantially no wear is observed. this is evaluated to be G (Good).

The shaping portion of the resinous die as the comparative example is wholly made of an epoxy resin and has a hardness of HN 43 kgf/mm$^2$.

In contrast, in the resinous die according to the preferred embodiment, portions where a high surface pressure is not applied are provided with an epoxy resin and have a hardness of HV 43 kgf /mm$^2$ while other portions where a high surface pressure is applied are provided with reinforcing pieces of aluminum-copper-based zinc alloy and have a hardness of HV 96 kgf/mm$^2$.

The aluminum-copper-based zinc alloy forming the reinforcing pieces consists essentially of 4.1% by weight of aluminum, 3.0% by weight of copper, 0.04% by weight of magnesium and the balance of zinc.

Press-shaping pressure employed in the resinous dies were 5 kgf/mm$^2$. Blank materials used in the test are cold roiled steel sheets having a thickness of 0.75 mm.

After 3000 shots, certain wear was observed in the shaping portion of the resinous die as the comparative example and hence the latter is evaluated to be NG. In contrast, substantially no wear was observed in the shaping portion of the resinous die according to the preferred embodiment after it went through 3000 shots. Hence, the latter is evaluated to be G. Consequently, the resinous die according to the preferred embodiment is more practicable than the resinous die as the comparative example.

Although the invention has been thus far described in relation to press-shaping of the blank material 85 into a panel for forming a vehicle body, it may also be applied to press-shaping of other articles.

In the preferred embodiment described above, the die member 12 is positioned on an upper side while the punch 30 and blank holder 50 are positioned on a lower side. Alternatively, the die member 12 may be positioned on a lower side while the punch 30 and blank holder 50 may be disposed on an upper side.

Although description has been made in the preferred embodiment as to application of an epoxy resin to die portions other than those where a high surface pressure is applied, other resins may also be employed in accordance with desired uses.

The aluminum-copper-based zinc alloy for producing the reinforcing pieces has been described to consist essentially of 4.1% by weight of aluminum, 3.0% by weight of copper, 0.04% by weight of magnesium and the balance of zinc. However, components of the aluminum-copper-based zinc alloy should not be limited to those specified.

Obviously, various minor changes and modifications of the present invention are possible in the light of the above teaching. It is therefore to be understood that within the scope of the appended claims, the invention may be practiced otherwise than as specifically described.

What is claimed is:

1. A resinous die for press shaping a blank sheet material into a desired configuration, comprising:

a die member including a shaping portion, said shaping portion having first means for receiving a first surface pressure during press-shaping operation of the resinous die, and second means for receiving a second surface pressure during press-shaping operation of the resinous die, the second surface pressure being larger than the first surface pressure, said first receiving means being formed of an epoxy resin layer and the second receiving means being formed of an epoxy resin layer and a reinforcing piece embedded in the epoxy resin layer with a surface of the reinforcing piece being exposed to air for reinforcing said shaping portion; and a punch including a shaping portion, said shaping portion of the punch having third means for receiving a third surface pressure during press-shaping operation of the resinous die, and fourth means for receiving a fourth surface pressure during press-shaping operation of the resinous die, said fourth surface pressure being larger than the third surface pressure, said third receiving means of the punch being formed of an epoxy resin layer and said fourth receiving means of the punch being formed of an epoxy resin layer and a reinforcing piece embedded in the epoxy resin layer with a surface of the reinforcing piece being exposed to air for reinforcing said shaping portion of said punch.

2. A resinous die according to claim 1, wherein said reinforcing pieces of said die member and said punch are made of an aluminum-copper-based zinc alloy.

3. A resinous die according to claim 1, wherein said epoxy resin layers of said shaping portions of said die member and said punch have a thickness falling in a range of 20–30 mm, and said reinforcing pieces of said shaping portions of said die member and said punch are partly embedded in said epoxy resin layers.

4. A resinous die according to claim 1, wherein said die member has a backup portion provided on a reverse side of said shaping portion of said die member for backing up said die member shaping portion, and said punch has a backup portion provided on a reverse side of said shaping portion of said punch for backing up said punch shaping portion.

5. A resinous die according to claim 4, wherein said backup portion of said die member comprises a filler layer provided by hardening a filler formed of an adhesive containing sand, said filler layer having embedded therein frameworks for reinforcing said filler layer, and cooling pipes for passing cooling water therethrough to cool said die member.

6. A resinous die according to claim 4, wherein said backup portion of said punch comprises a filler layer provided by hardening a filler formed of an adhesive containing sand, said filler layer having embedded therein a framework for reinforcing said filler layer, and cooling pipes for passing cooling water therethrough to cool said punch.

7. A resinous die according to claim 1, further comprising a blank holder disposed vertically movably around said punch for holding a flange of the blank material in cooperation with a mating portion of said shaping portion of said die member upon press-shaping of said blank material to thereby prevent wrinkling of said flange of said blank material, said blank holder comprising an epoxy resin layer provided on a side thereof opposed to said mating portion of said shaping portion of said die member.

8. A resinous die according to claim 7, wherein said blank holder comprises a backup portion provided on a reverse side of said epoxy resin layer for backing up said epoxy resin layer, said backup portion comprising a filler layer provided by hardening a filler formed of an adhesive containing sand and having embedded therein cooling pipes for passing cooling water therethrough to cool said blank holder.

9. A resinous die according to claim 1 wherein said reinforcing pieces of said die member and said punch have a hardness larger than that of said epoxy resin layers of said die member and said punch.

10. A resinous die according to claim 9 wherein said reinforcing pieces of said die member and said punch have a hardness of HV 96 $kgf/mm^2$ and said epoxy resin layers of said die member and said punch have a hardness of HV 43 $kgf/mm^2$.

* * * * *